US006302043B1

(12) United States Patent
Wippermann

(10) Patent No.: US 6,302,043 B1
(45) Date of Patent: Oct. 16, 2001

(54) DISCOVERY BOAT

(76) Inventor: Gerhard Wippermann, Roermonder Strasse 117, D-41068 Mönchengladbach (DE)

( * ) Notice: Subject to any disclaimer, the term of this patent is extended or adjusted under 35 U.S.C. 154(b) by 0 days.

(21) Appl. No.: 09/485,317

(22) PCT Filed: Aug. 5, 1998

(86) PCT No.: PCT/EP98/04872

§ 371 Date: May 16, 2000

§ 102(e) Date: May 16, 2000

(87) PCT Pub. No.: WO99/07597

PCT Pub. Date: Feb. 18, 1999

(30) Foreign Application Priority Data

Aug. 8, 1997 (DE) ..... 297 14 194 U
Mar. 17, 1998 (DE) ..... 198 11 492

(51) Int. Cl.[7] ..... B63B 35/00
(52) U.S. Cl. ..... 114/66
(58) Field of Search ..... 114/66, 333, 125, 114/61.22, 312, 357

(56) References Cited

U.S. PATENT DOCUMENTS

| | | | | |
|---|---|---|---|---|
| 1,786,091 | | 12/1930 | Stiles . | |
| 3,351,035 | * | 11/1967 | McLean | 114/66 |
| 3,379,157 | * | 4/1968 | Post | 114/66 |
| 3,613,621 | * | 10/1971 | McKinley | 114/66 |
| 4,145,783 | | 3/1979 | Rhodes . | |
| 4,276,851 | | 7/1981 | Coleman . | |
| 4,290,156 | | 9/1981 | Rawson . | |
| 4,494,472 | * | 1/1985 | Rougerie | 114/66 |
| 4,841,896 | * | 6/1989 | Fury | 114/312 |
| 4,895,539 | | 1/1990 | Bender . | |
| 5,117,774 | | 6/1992 | English et al. . | |
| 5,988,088 | * | 11/1999 | Ishida et al. | 114/66 |

FOREIGN PATENT DOCUMENTS

| | | | | |
|---|---|---|---|---|
| 554889 | | 9/1986 | (AU) . | |
| 9407816 | | 9/1995 | (DE) . | |
| 0277068 | | 8/1988 | (EP) . | |
| 1454694 | | 12/1966 | (FR) . | |
| 2258304 | | 8/1975 | (FR) . | |
| 2287380 | * | 5/1976 | (FR) | 114/331 |
| 2463049 | | 2/1981 | (FR) . | |
| 2606359 | | 5/1988 | (FR) . | |
| 0553064 | | 7/1993 | (FR) . | |
| 2227468 | | 8/1990 | (GB) . | |
| 57-87786 | * | 6/1982 | (JP) | 114/312 |

OTHER PUBLICATIONS

"Underwater vistas" Ship and Boat, No. 6, Jul. 1991, p. 30 London, Great Britain.

* cited by examiner

*Primary Examiner*—Ed Swinehart
*Assistant Examiner*—Ajay Vasudeva
(74) *Attorney, Agent, or Firm*—Martin A. Farber

(57) ABSTRACT

The invention relates to a discovery boat (1) with a viewing cabin located beneath the surface of the water. Said viewing cabin has large viewing windows looking out to the side and forwards. According to the invention, the viewing cabin is a transparent vessel which is open from above and which is located in an opening of a deck, said deck extending between two floating bodies (2). This ensures a simple, versatile construction.

41 Claims, 12 Drawing Sheets

38
39
30
A
35
31
39
38
37
4
5
42
33
34
25
32
26
27
22
28
14
20
2
29
24
44
46
23
9
3
T
40
21
47
1

DISCOVERY BOAT

FIELD AND BACKGROUND THE INVENTION

The invention relates to a discovery boat having an observation cabin which is disposed below the surface of the water and has large format observation windows facing to the side and forwards.

A known discovery boat of this type has a relatively wide hull with an observation cabin, which is submerged into the water, leading off in a downwards direction from it. In the rear region, the hull becomes wider, with ballast tanks being formed.

SUMMARY OF THE INVENTION

The subject-matter of the invention is based on the object of providing the construction of a discovery boat of the type under discussion in a simpler and more versatile manner.

This object is achieved first and foremost in the case of a discovery boat of in which it is specified that the observation cabin is a transparent container which is open from above and is disposed in an opening in a deck extending between two floating bodies.

As a result of such a construction, a discovery boat of the type in question is provided, which is distinguished by a high use value and a favourable construction. It is not a single-hull boat; rather, in certain respects, it is a catamaran, the two floating bodies of which carry the deck extending between them. This deck is, in turn, carrier for the transparently constructed container which forms the observation cabin. Associated with this construction is high stability of the discovery boat when floating. A variation during the production of the discovery boat is possible in a simple manner, specifically in that merely by enlarging the spacing between the floating bodies, the deck also obtains a different size. Then another variation can be undertaken by an appropriate choice of floating bodies. Accordingly, the discovery boat according to the invention is constructed on the basis of a modular principle, which permits production costs to be reduced. In addition, the transparently constructed container provides an optimum view to all sides. Advantages in terms of transport engineering arise if the container can be separated from the hull of the boat. The corresponding mounting of the container, i.e. the association of it with the deck, can be carried out in a simple manner even by non-professionals. For the purpose of reducing drag, the container has a hydrodynamically rounded front. Otherwise, the container is substantially formed in two parts, with a transparent, tub-like bottom part and a sealing collar adjoining it approximately in the region of the waterline and providing the connection to the deck. A separable construction of bottom part and sealing collar is also recommended here. The sealing collar does not need to be made transparent. It fulfils a double function in that it forms a seat surround, i.e. a bench flanking the container mouth. Furthermore, provision is made for the rear wall of the container to constitute a flattened backrest, with the result that the container bottom serves as a seat surface. The container is dimensioned such that it provides space for two people sitting next to each other. Furthermore, provision is made to provide control- and/or drive-actuating mechanisms in the container, so that the discovery boat can be controlled from the observation cabin. Moreover, the transparent bottom of the container is formed to be flat. In order to protect the container, which is fashioned, for example, from acrylic glass, plexiglass etc., from damage, a bumper arrangement surrounds it. This bumper arrangement is preferably secured to the deck. In addition, the bumper arrangement is also used to hold, in the rear region, transporting wheels projecting beyond the container bottom. This allows the discovery boat to be put into the water or allows it to be pulled out of this element in an easier and danger-free manner. The deck furthermore constitutes a platform which can preferably be used for sunbathing, games etc. Advantages in terms of transport engineering arise by the platform being divided into two by a separating joint running in the longitudinal direction of the boat. At the rear end, the deck itself is carrier for a bench, so that the discovery boat is optimally equipped with seating opportunities. A pedal crank mechanism for the boat drive can be mounted in front of this bench itself. Furthermore, the bench can be used in order to accommodate an integrated cool-box. This results in a space-saving construction. A further advantageous feature of the invention is to be seen in the fitting of the discovery boat with a roof covering the deck including the container shaft. Solar cells disposed on this roof can be used to charge batteries for an electric drive of the discovery boat. Further complying with the modular principle is the measure of connecting the two floating bodies to each other by means of cross-beams. In detail, the latter are constructed so that they are inserted releasably into the floating bodies, which is associated with easier mounting and also removal. Furthermore, the cross-beams are carriers for the deck, so that they fulfil a further function. Advantages in terms of transport furthermore arise by the floating bodies forming individual hulls which can be separated transversely into two parts each. For the purpose of realising simple mounting and also removal, the individual hulls are plug-connected to one another. The space between the individual hulls is used to accommodate a pedal-driven paddle wheel. In order to stabilise the boat body, a ballast tank which can be filled with water is provided. The said ballast tank is formed in the shape of a U in plan view. Nesting together in association with a space-saving construction arises by the ballast tank surrounding the container sealing collar, specifically by the U-web facing forwards, i.e. in the direction of travel. Even the ballast tank is itself brought into the modular principle, by its being formed from two separate chambers which can be separated from each other. Securing of the ballast tank is effected below the deck. Otherwise, it fills the intermediate space between floating body and container side wall. It is advantageous as far as safety regulations are concerned to provide a net which can be stretched over the mouth of the container. This net may optionally even serve as a hammock. Advantages concerning safety regulations furthermore arise by the bumper arrangement forming a ring encircling the container bottom. The container region, which is particularly at risk, is therefore protected. It is optimal here for the ring to be formed as a double ring and to project below the bottom. The rear subregion of the ring is then used to receive the axles for the transporting wheels. In detail, this appears in such a way that the straight, rear region of the ring is aligned with the wheel axles. In order to stably secure the double ring in its front region, use is made of a front rod which extends from this double ring and is secured to the front end of the deck. The discovery boat obtains good manoeuvring capability by means of a double rudder system with a rudder blade associated with each floating body. The intermediate space between these rudder blades can be used to accommodate a propeller drive. It is preferably powered electrically, specifically by a battery incorporated in the bench. There is coupling between the propeller drive and the rudder blades in such a manner that the rudder blades can be pivoted synchronously with a displacement of the propeller drive about a pivot axis. With regard to the ballast tanks, it should furthermore be stressed that they are located above the waterline. Finally, an advantageous feature furthermore resides in the masts for the roof being based in or on the floating bodies. A plug-in connection can also be provided here, this connection firstly simplifying the installation, and secondly bringing about great stability with respect to the stability of the masts under load.

An alternative is distinguished by the mouth of the container shaft being covered by a three-part covering which can be unfolded into a bench position. The covering accordingly fulfils a double function: firstly, it is used, in the position occupying a planar surface, as a covering for the container shaft, so that when the discovery boat is not in service, the ingress of dust, moisture etc. into the interior of the container shaft is prevented. The covering can also serve in this position as a sunshade. Secondly, the unfoldable covering in its bench position provides a seating opportunity for boat users, the seat surface being extended by the seat surround with enlargement of the bench surface. The seat surround is then also used by at least some of the masts engaging through a retaining opening, which is spaced apart from the deck, in the seat surround and being fixed on a plug-in base associated with the deck. In this way a stable support for the relevant masts for the sunroof is achieved, so that no cross-beam needs to be used at the base end for masts supported by the seat surround. Provision is furthermore made for the plug-in base to be screwed into a threaded sleeve in the screw connection holding the cross-beam to the hull. The respective plug-in base provided in the region of the cross-beam is thereby secured in a particularly stable manner, with the result that the mast carried by it is secured in a stable manner. The plug-in base is connected in integral manner into the screw connection between cross-beam and hull, which is associated with particularly high stability in the region of the screw connection. In detail, with regard to the screw connection, the arrangement is such that the threaded sleeve is seated in a screw cut-out in the cross-beam and is screwed onto a threaded rod securely laminated into the hull. However, it is also possible to fit a railing rod onto the plug-in base. Furthermore, provision is made, according to the invention, for the plug-in base to hold a cover plate. In order to prevent the container from being bumped during transportation on land or in water, the bumper protection is secured in the bottom region on the container. In this arrangement, the bumper protection, which is formed as a ring, surrounds the container bottom at a spacing and is secured to the container by mounting webs.

BRIEF DESCRIPTION OF THE DRAWINGS

In the following, two exemplary embodiments of the invention are explained with reference to the drawings, in which FIG. 7 shows the section along the line VII–VII in FIG. 6.

DETAILED DESCRIPTION OF THE PREFERRED EMBODIMENT

Figure 1:
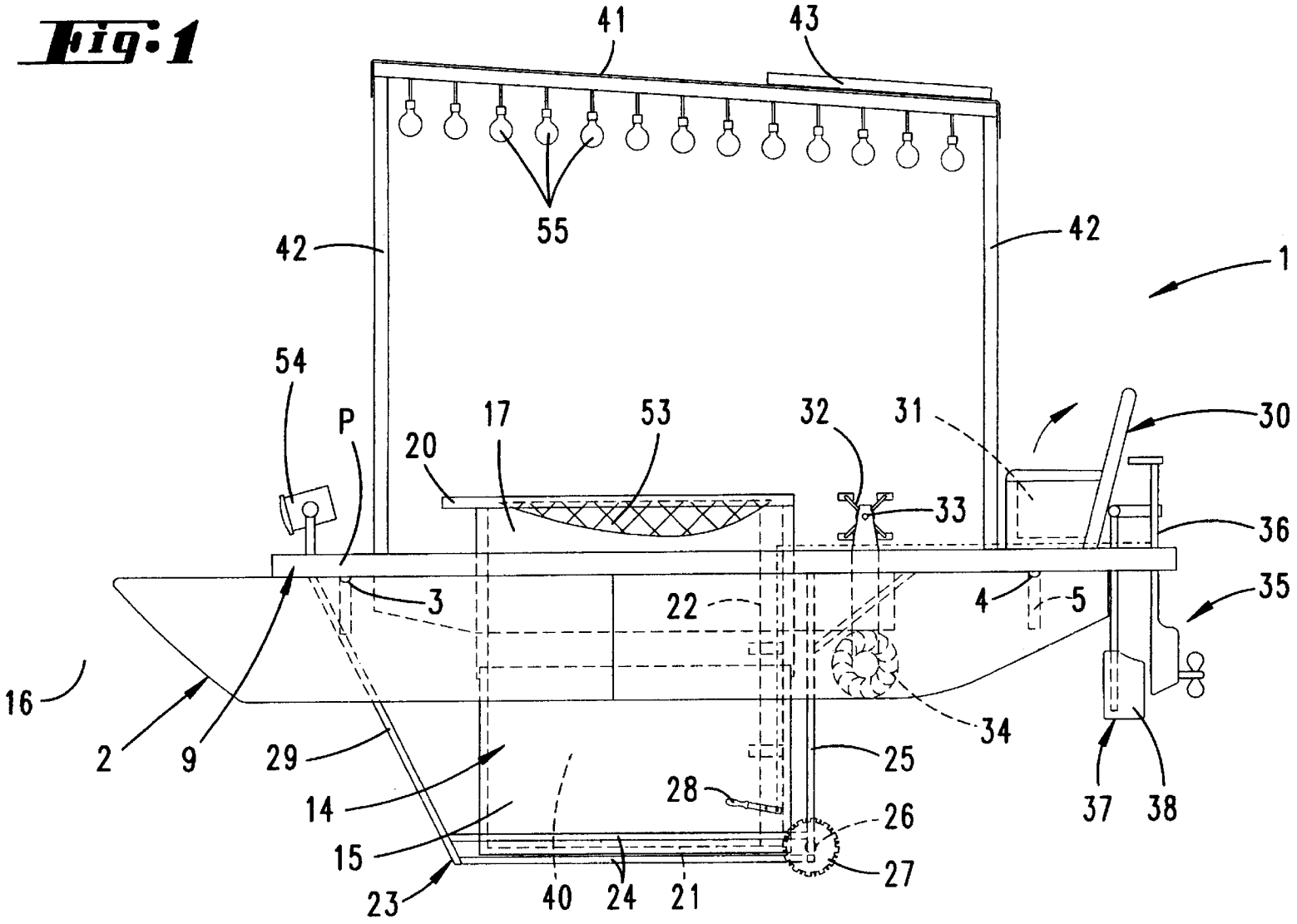
FIG. 1 shows, in a schematic illustration, a side view of a discovery boat, relating to the first embodiment.
Figure 2:
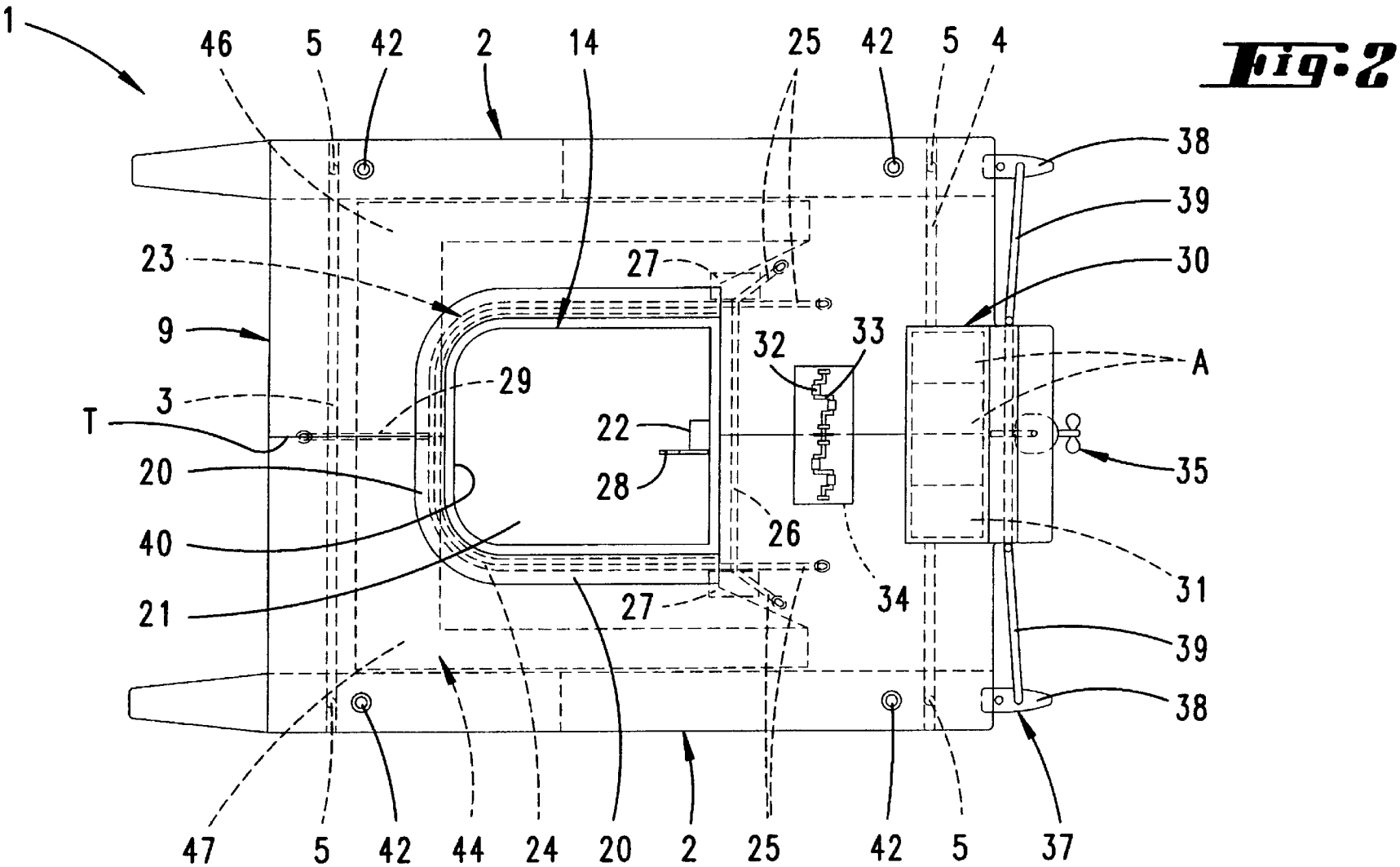
FIG. 2 shows a plan view of the discovery boat, with the roof omitted.

According to the first embodiment, the discovery boat, which is denoted as a whole by the numeral 1, has two floating bodies 2 which are disposed parallel to each other, form the hull and are connected to each other by means of two cross-beams 3 and 4. Leading off from the ends of the cross-beams 3, 4 are downwardly directed plug-in pegs 5 which enter into plug-in openings 6, which match them in cross section, in the floating bodies 2. The plug-in pegs are fixed there by means of means (not shown).

Each floating body 2 forms individual hulls 2', 2" which can be divided transversely into two parts each. In regard to the individual hulls 2', these are the bow-side ones, from which there extend plug-in bolts 7, which project over the separating joint. These plug-in bolts engage in plug-in holes 8, which are associated with them, in the individual hull 2".

Figure 4:
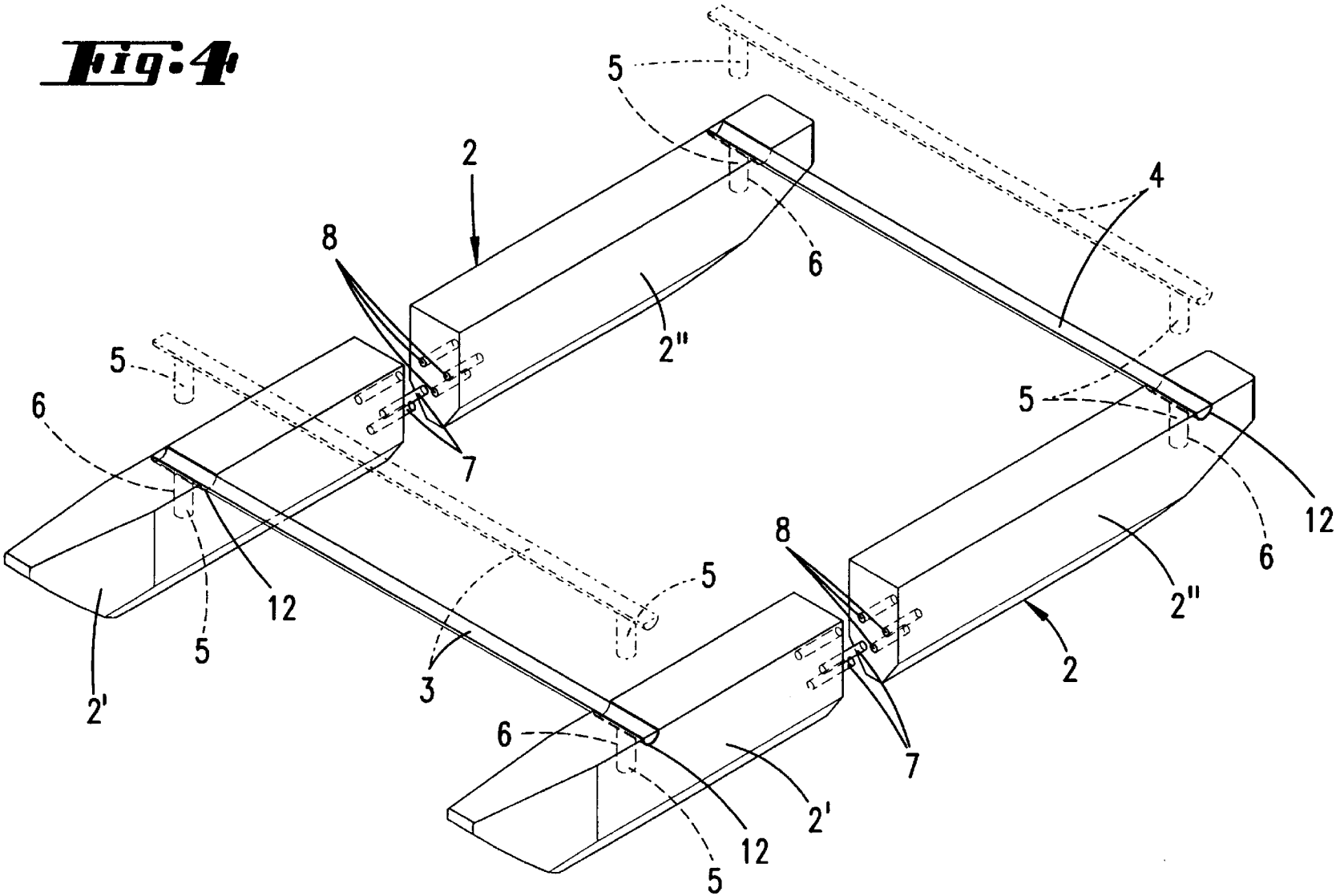
FIG. 4 shows a perspective illustration of the floating bodies which can be divided transversely, together with the cross-beams connecting them, specifically before the individual hulls are plugged together.
Figure 5:
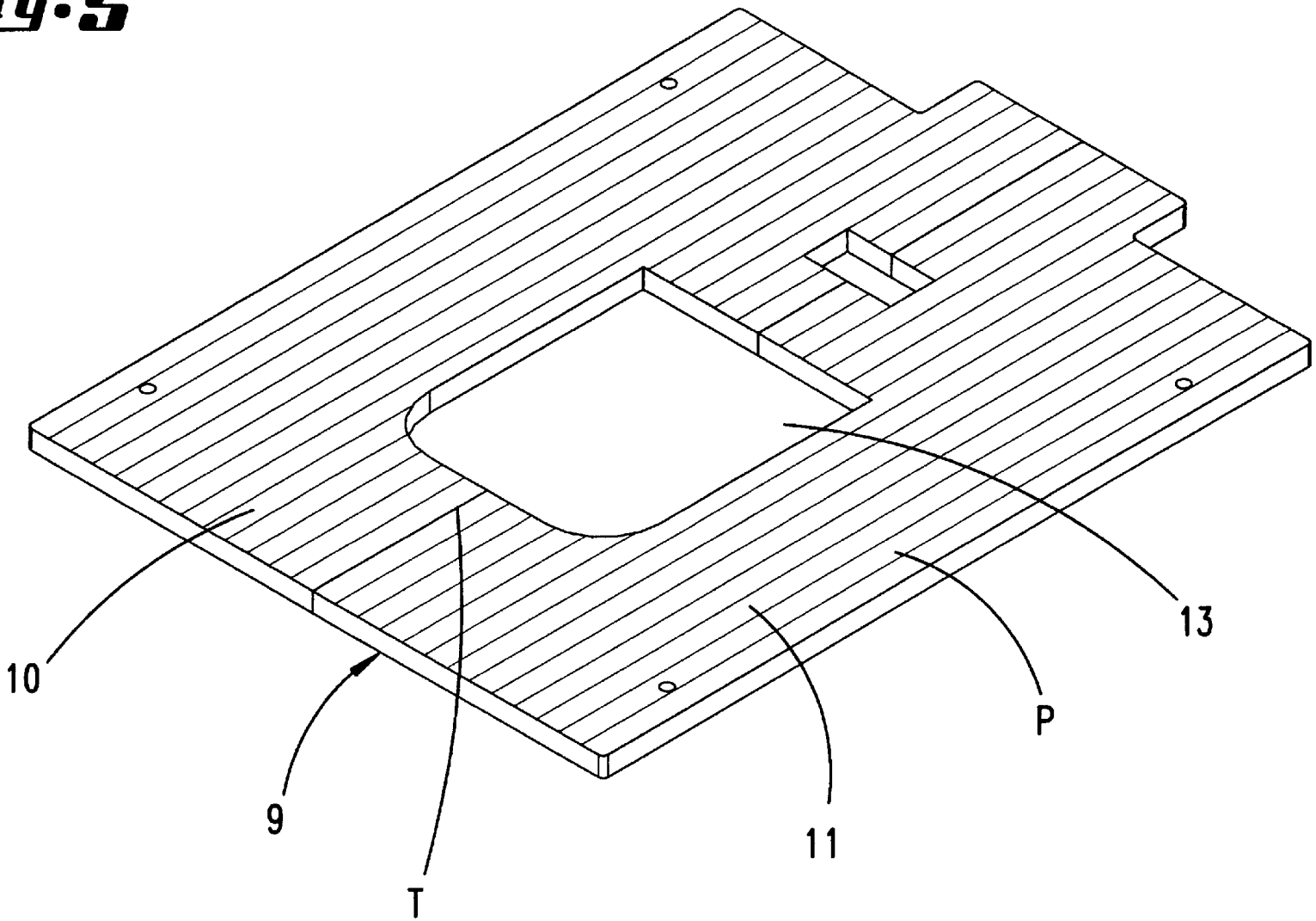
FIG. 5 shows a perspective illustration of the deck divided into two in the longitudinal direction of the boat.
Figure 1:
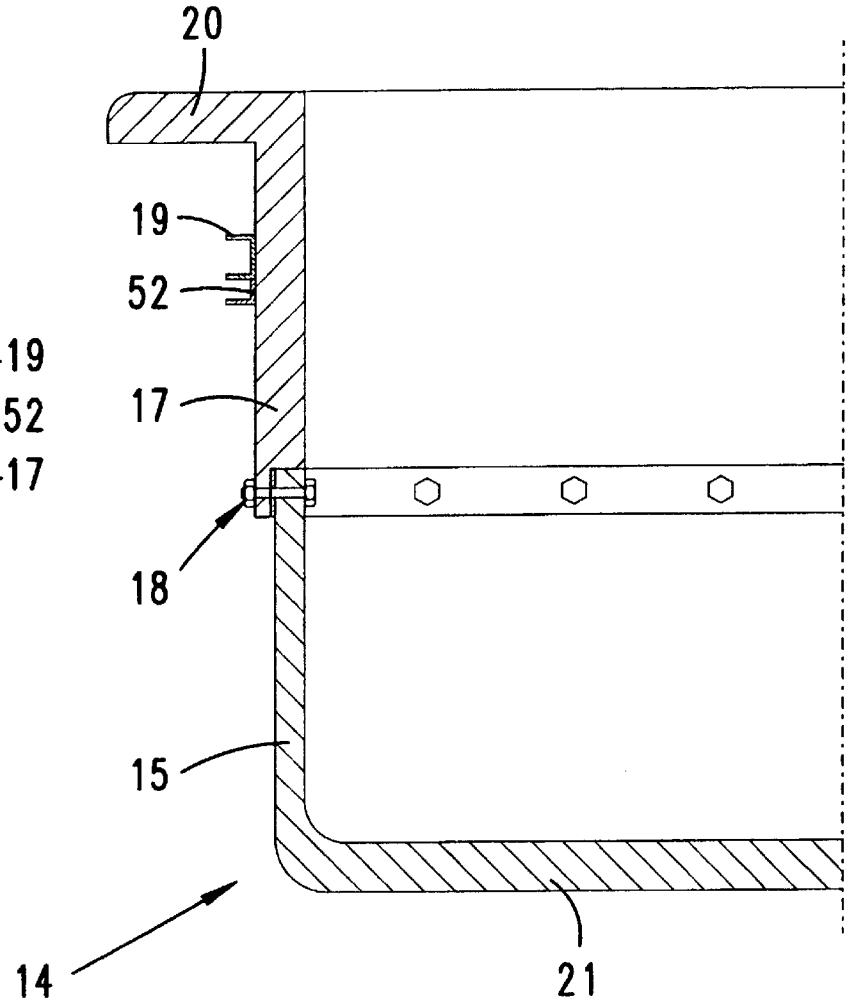

Between the two floating bodies 2, there extends a deck 9 which also partly covers the upper side of the floating bodies. In detail, this deck forms a platform P, the platform being divided in two by a separating joint T which runs in the longitudinal direction of the boat, the parts 10 and 11 extending on either side of it. This platform P is substantially rectangular in plan view. The deck 9 is connected in a manner which is not shown to the two floating bodies 2 to form a unit. In the connected position, the deck 9 covers the cross-beams 3 and thereby secures the plug-in engagement between the plug-in pegs 5 and the plug-in openings 6, so that a separate means of securing in this regard can be omitted. For this purpose, the ends of the cross-beams 3, 4 are located in a positive manner in transverse grooves 12 in the individual hulls 2', 2". From FIG. 4, it is particularly clearly shown that the cross-beam 3 is associated with the front individual hulls 2' and the cross-beam 4 is associated with the rear individual hulls 2".

Figure 6:
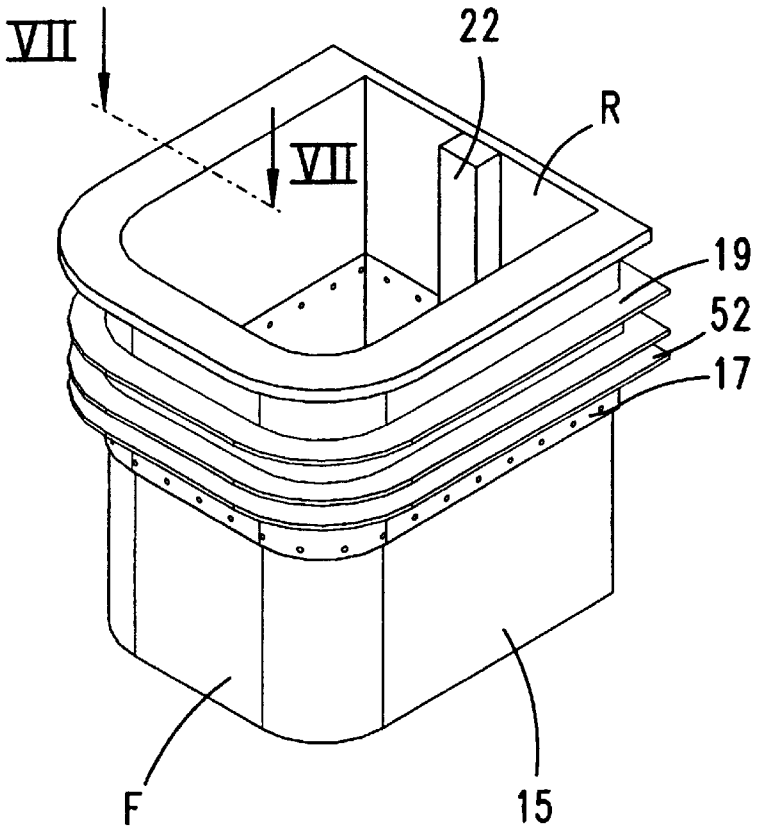
FIG. 6 shows a perspective illustration of the observation cabin formed by a container.
Figure 9:
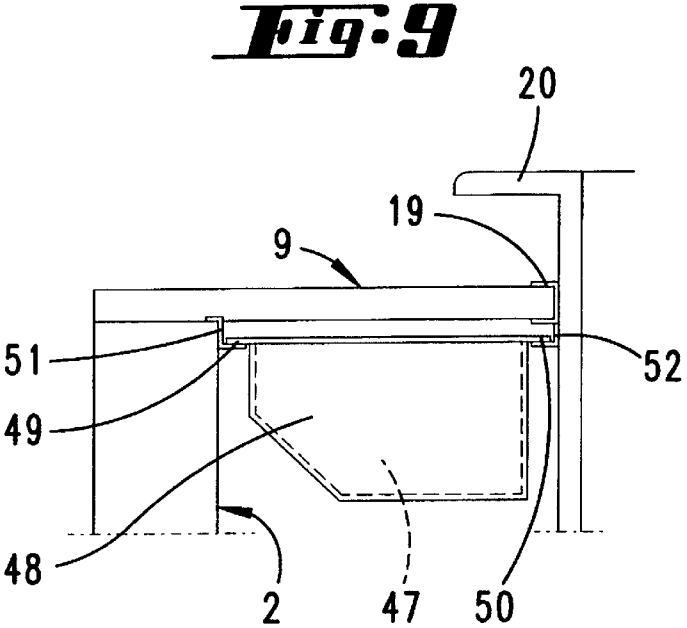
FIG. 9 shows a cross section through the one U-limb of the ballast tank, in the region where it is secured below the deck.
Figure 8:
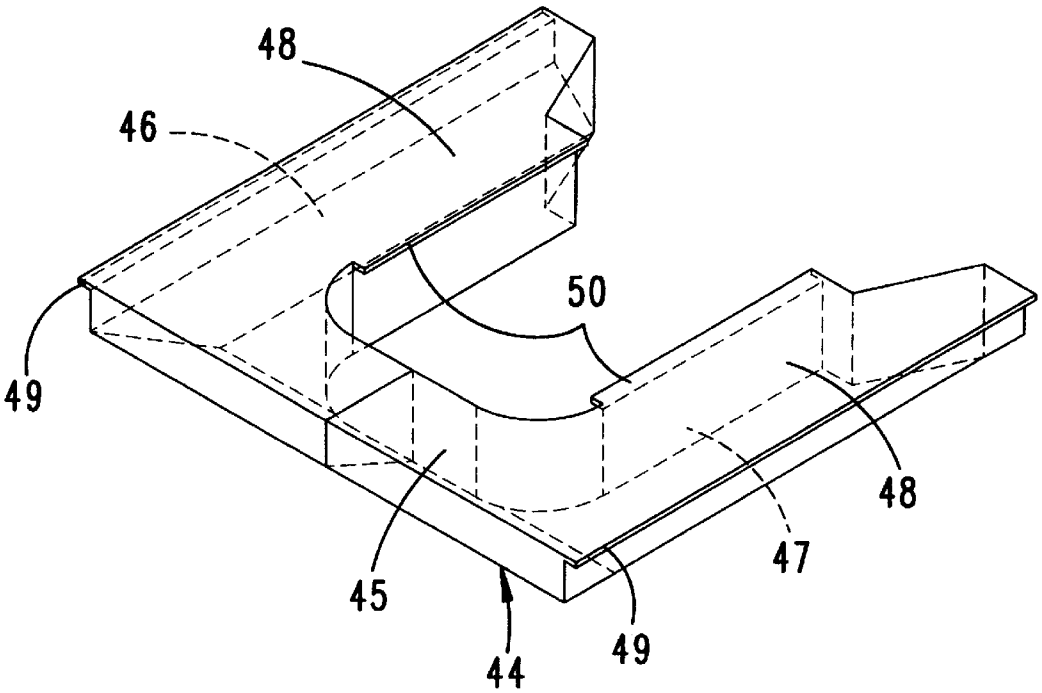
FIG. 8 shows a perspective illustration of the ballast tank which is U-shaped in plan view and forms two separate chambers.
Figure 10:
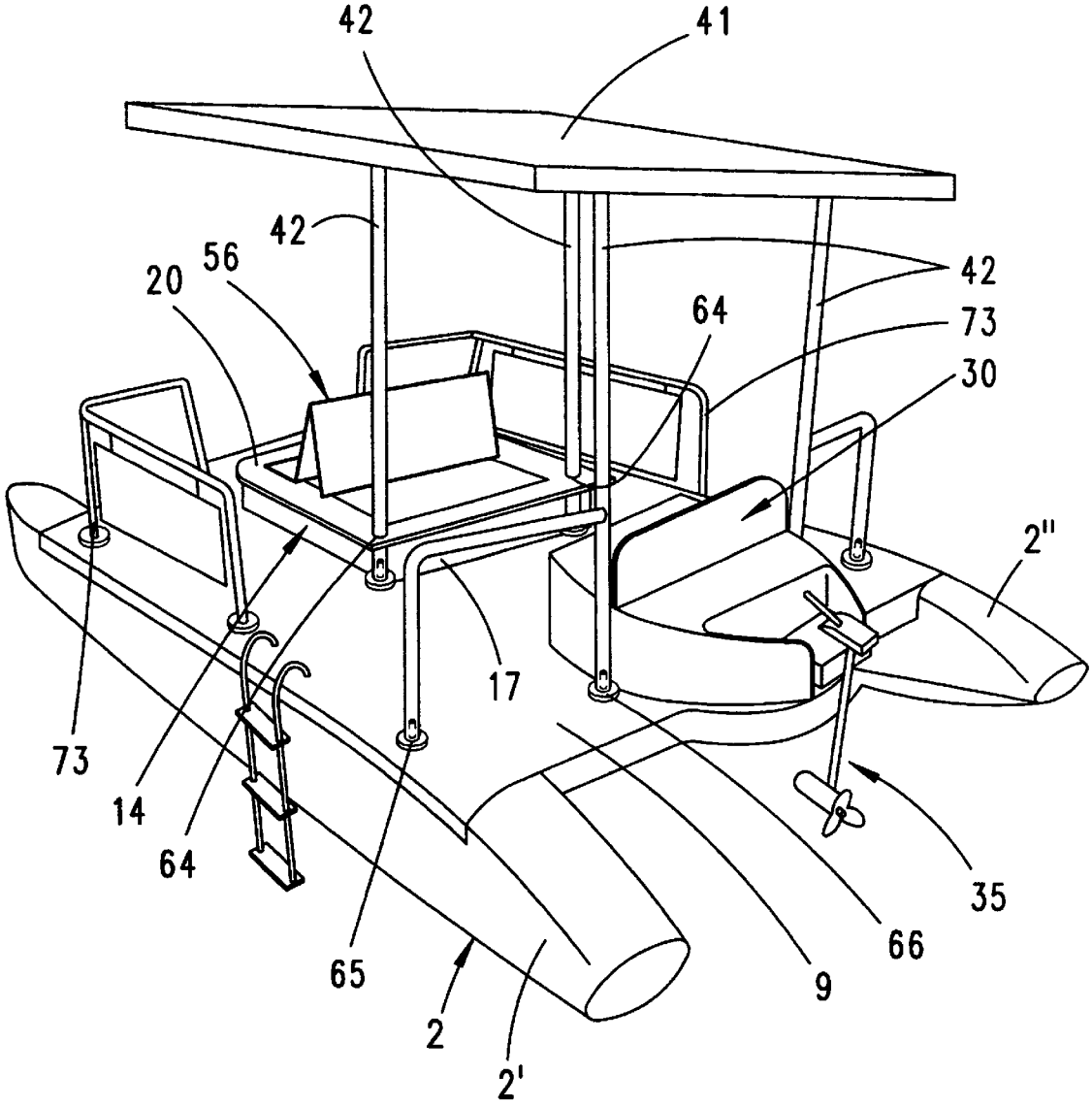
FIG. 10 shows a perspective illustration of the discovery boat according to the second embodiment.
Figure 11:
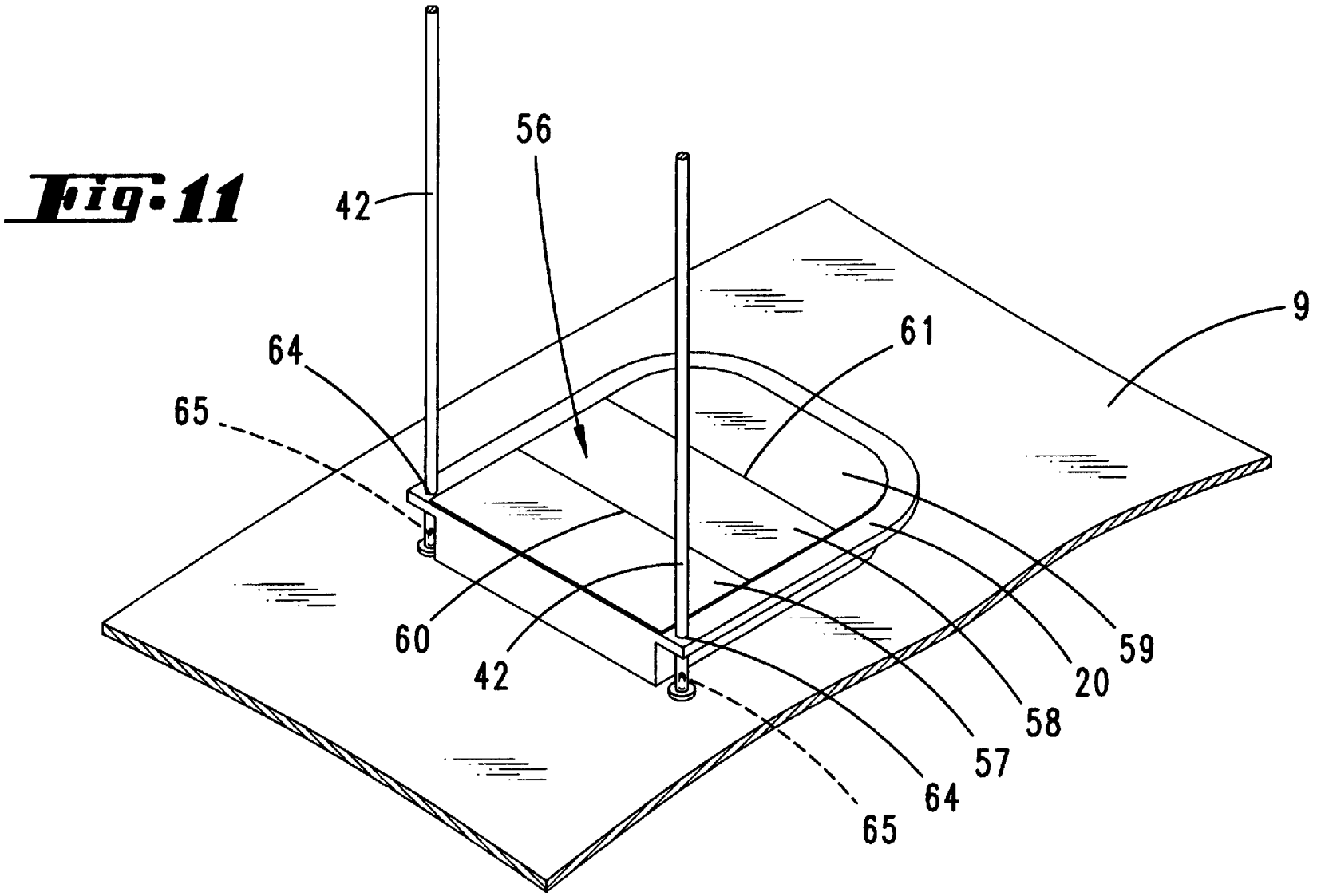
FIG. 11 shows a perspective illustration in the region of the container shaft covered at the mouth end.

The platform P which forms the deck 9 and is supported by the cross-beams 3, 4 has an opening 13 crossing the separating joint T. This opening accommodates an observation cabin in a positive manner. The observation cabin is a transparent container 14 which is open from above and is disposed between the two floating bodies 2. The container 14 is constructed such that it can be separated from the hull and from the deck 9. The container 14 is basically formed in two parts. It has a transparent, tub-like bottom part 15 and a sealing collar 17 adjoining it approximately in the region of the waterline 16. There is a screw connection 18 between the bottom part 15 and the sealing collar 17, cf. FIG. 7, in particular, in this respect. On the outside, the sealing collar 17 carries a horizontally aligned, U-shaped mounting rail 19 which is connected fixedly to it, extends around it in annular manner, encircles the corresponding boundary edges of the opening 13 and thus holds the container 14 in its position with respect to the hull and with respect to the deck 9. In the mounted position of the container 14, its bottom part 15 projects beyond the keel line of the floating bodies 2. Furthermore, the sealing collar 17 protrudes over the surface of the deck 9 and forms a U-shaped seat surround 20 there. In contrast to the transparent, tub-like bottom part 15, the sealing collar 17 does not need to consist of see-through material. In addition, the container has a hydrodynamically rounded front F which faces in the direction of travel. It can then be seen from FIG. 6 that the rear wall R of the container forms a flattened backrest. Furthermore, the container 14 is dimensioned such that it provides space for two people sitting next to each other. The transparent bottom 21 of the bottom part 15 and of the container 14 is formed to have a flat surface.

On the inside, the rear wall R of the container 14 carries a shaft 22 in order to accommodate control- and/or drive-actuating mechanisms 28 there, so that it is possible to control the discovery boat from the observation cabin.

Figure 3:
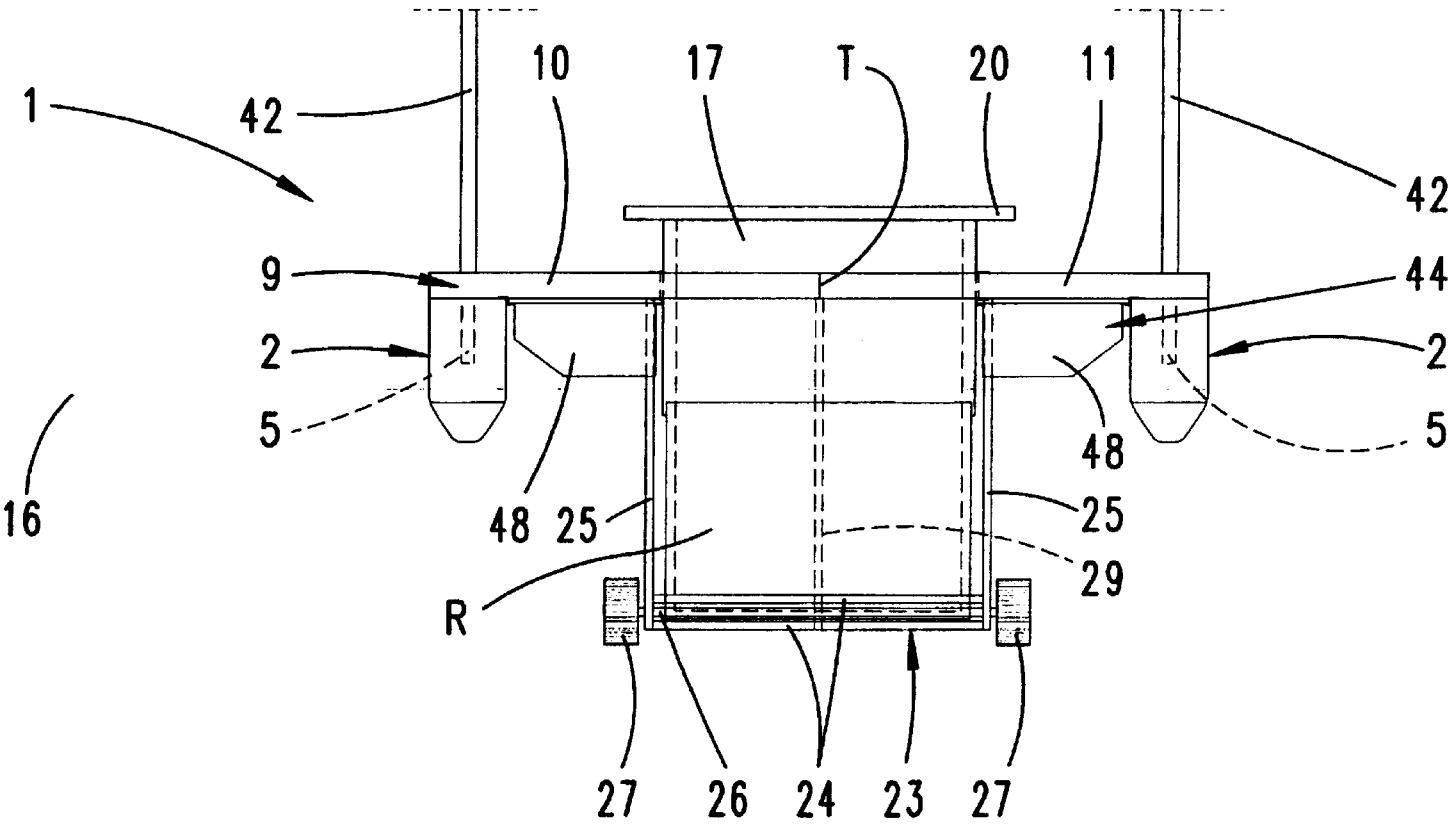
FIG. 3 shows a rear view of the discovery boat.

Furthermore, the container 14 is surrounded by a bumper arrangement 23. This bumper arrangement forms a ring 24 encircling the container bottom 21. The ring is formed as a double ring in such a manner that the lower ring projects below the container bottom 21, cf. FIGS. 1 and 3. The double ring runs approximately parallel to the plan-view shape of the container bottom 21. Accordingly, in the rear region, the double ring is fashioned such that it is straight. Extending in an upwards direction from this straight region are two supporting rods 25 which lead to the deck and are secured to the deck 9 at their upper end. At the lower end, the two supporting rods 25, which are located on both sides of the observation cabin, are provided with axles 26 for receiving transporting wheels 27 which project downwards over the lower ring of the double ring 24.

It can furthermore be seen from FIG. 1 that the straight, rear region of the double ring 24 is aligned with the wheel axles 26. Extending from the front, central region of the double ring 24 and directed obliquely upwards is a front rod 29 which, for its part, is secured to the front end of the deck 9. The container 14 thereby obtains optimum protection against impact on all sides.

On the rear side, the deck 9 is carrier for a bench 30 which has an integrated cool-box 31 below the seat surface. Then, below the seat surface, a separate space can also be provided, in order, for example, to accommodate rechargeable batteries A. A pedal crank mechanism 32 configured for two people is mounted in front of the bench 30. The crankshaft 33 of this mechanism drives a paddle wheel 34 extending between the floating bodies 2.

In the region behind the bench 30, an electrically powered propeller drive 35 is provided in the longitudinal centre of the discovery boat 1. This propeller drive can be pivoted about a vertical tiller-forming shaft 36. The pivoting displacement of the propeller drive 35 is transmitted synchronously to a double rudder system 37. For this purpose, an individual rudder blade 38 is associated with each floating body 2, the two rudder blades 38 acting on the tiller by way of coupling rods 39. The propeller drive 37 is thus coupled to the control mechanism 28.

Furthermore, the deck 9 carries a roof 41 which covers it including the container shaft 40. In plan view, this roof is fashioned such that it is rectangular. The masts 42 for the roof 41, which masts are provided in the corner region of the roof 41, are based in or on the floating bodies 2. If the base ends engage in the floating bodies 2, this is associated with particularly high stability for the masts. The rear subregion of the roof 41 is used in order to accommodate solar cells 43 which serve to charge batteries, not shown, for the electric operation of the propeller drive 35.

To ensure that the discovery boat 1 is sufficiently stable when floating, use is made of a ballast tank 44 which can be filled with water. The ballast tank is situated above the waterline 16, cf. FIG. 1, in particular, in this respect. In plan view, the ballast tank is fashioned in the shape of a U and surrounds the container sealing collar 17 in such a manner that the U-web 45 of the ballast tank 44 faces forwards.

In detail, the ballast tank 44 has two separate chambers 46, 47 which can be separated from each other. The separating joint runs in the longitudinal direction of the vehicle. These individual chambers may be plugged together in a suitable manner. In order to secure the ballast tank 44, the tank provides edge flanges 49, 50 protruding at the upper end of the two U-limbs 48. The edge flange 49 is adjacent to the floating body 2 and engages over a Z-shaped retaining strip 51 of the deck 9, while the edge flange 50 rests on an angle leg 52 of the angle piece which extends around the sealing collar 17 in annular manner. The angle leg 52 in question extends below the mounting rail 19, so that the ballast tank 44 is covered by the deck 9. Otherwise, the ballast tank 44 fills, with its U-limbs 48, the intermediate space between the floating bodies 2 and the container side walls.

For safety reasons, a net 53 is associated with the mouth of the container shaft 40, cf. FIG. 1. The net 53 may optionally also be used as a hamdock Then, on the bow side of the deck 9 is a manual beam emitter 54, which is switched on when travelling at night. There is likewise a chain of lights 55 on the roof 41 for the purpose of travelling at night.

In the second embodiment, illustrated in FIGS. 10 to 15, components carry the same reference numerals. One difference is that the mouth of the container shaft 40 is now covered by a three-part covering 56. The latter is composed of three individual covering plates 57, 58, 59, which are connected in an articulated manner to one another, in such a manner that the central individual covering plate 58 is connected to to the individual covering plates 57, 59 neighbouring it by way of folding edges 60, 61. The folding edges 60, 61 here run transversely to the longitudinal direction of the discovery boat. According to FIG. 11, the individual covering plates 57, 58, 59 take up their position covering the container shaft 40 in such a way that, for example, protection against the sun and light is achieved, in order, for example, to be able to better view the water environment from the container interior.

Figure 12:
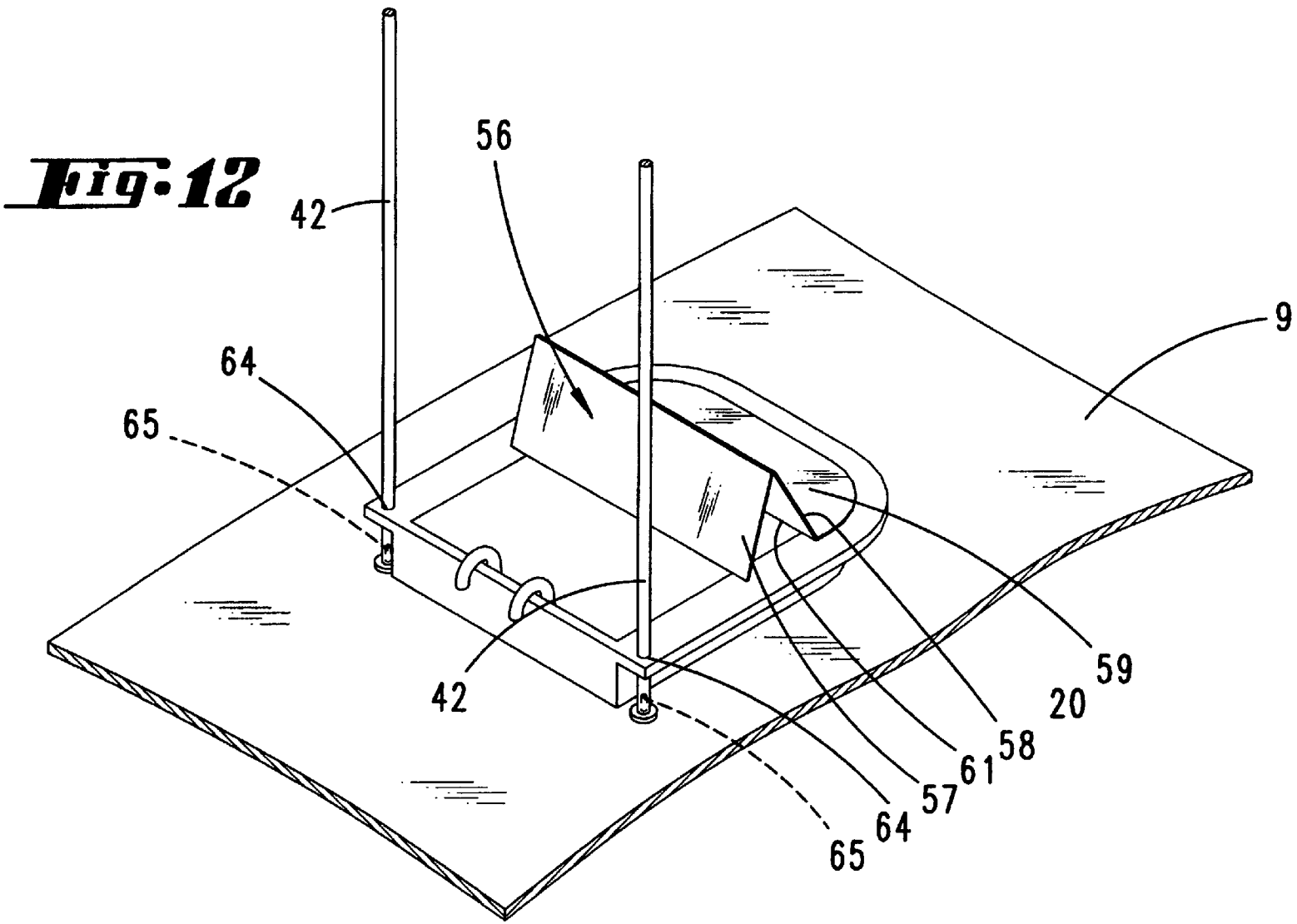
FIG. 12 shows an illustration corresponding to FIG. 11, but with the covering unfolded into a bench position.

However, it is also possible to bring the covering 56 into the bench position, shown in FIG. 12. In this case, the individual covering plate 59 constitutes the seat surface, while the adjoining individual covering plate 58, which runs at an angle to the plate 59, serves as a backrest. The individual covering plate 57, which runs in a downwards direction by way of the folding edge 60, rests on the seat surround 20 and can be fixed in its position there by means of a catch, not illustrated, for example. With the provision of a plurality of catches, the inclination position of the individual covering plate 58 forming the backrest can be varied.

Figure 13:
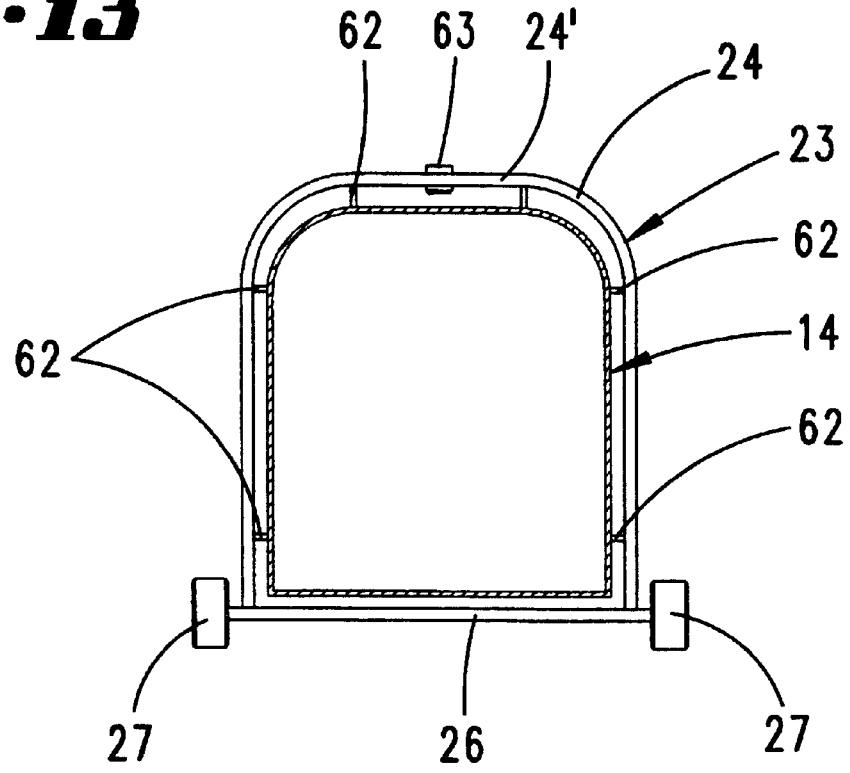
FIG. 13 shows a horizontal section through the container, with a view of the bumper arrangement which is provided at the bottom end of the container and whose ring surrounds the container bottom at a distance.
Figure 14:
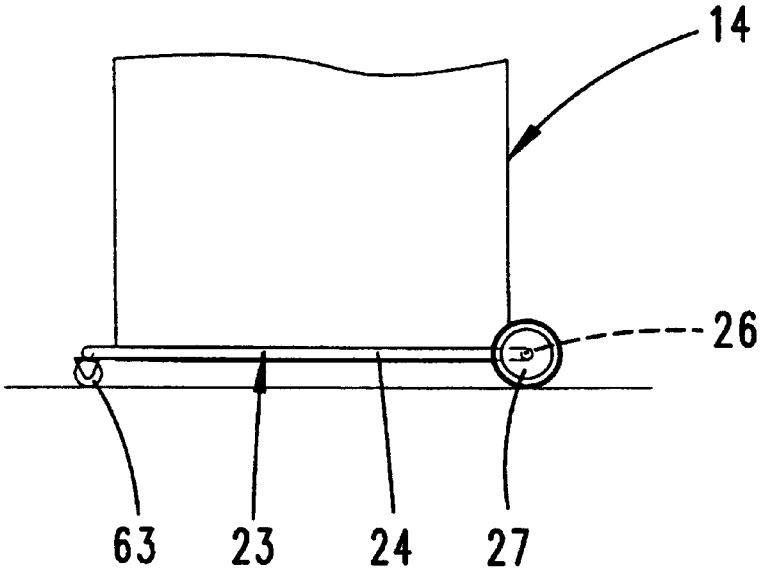
FIG. 14 shows a side view towards the lower end of the container with a bumper arrangement associated with the latter.

FIGS. 13 and 14 show that the bumper arrangement 23 is mounted in the bottom region of the container 14. The relevant ring 24 runs parallel to the outer wall of the container 14 and is there secured to the container 14 by mounting webs 62.

The ring section 24', which faces in the bow direction, carries a supporting wheel 63 in the form of a roller, and so, in conjunction with the transporting wheels 27, when the discovery boat is put down, it is reliably avoided that the container bottom is placed on the ground.

According to this second exemplary embodiment, two of the masts 42 holding the roof 41 are arranged in alignment with the seat surround 20 of the container shaft 40. These masts 42, which are situated closer to the bow of the boat, engage through retaining openings 64, which are associated with them, in the seat surround 20, in order for their free, lower ends, to enter into overlap with supporting bases 65 in the deck. These masts 42 in question are therefore supported at two points, namely the supporting bases 65 and the retaining openings 64, which is associated with these masts 42 having high stability under load.

Figure 15:
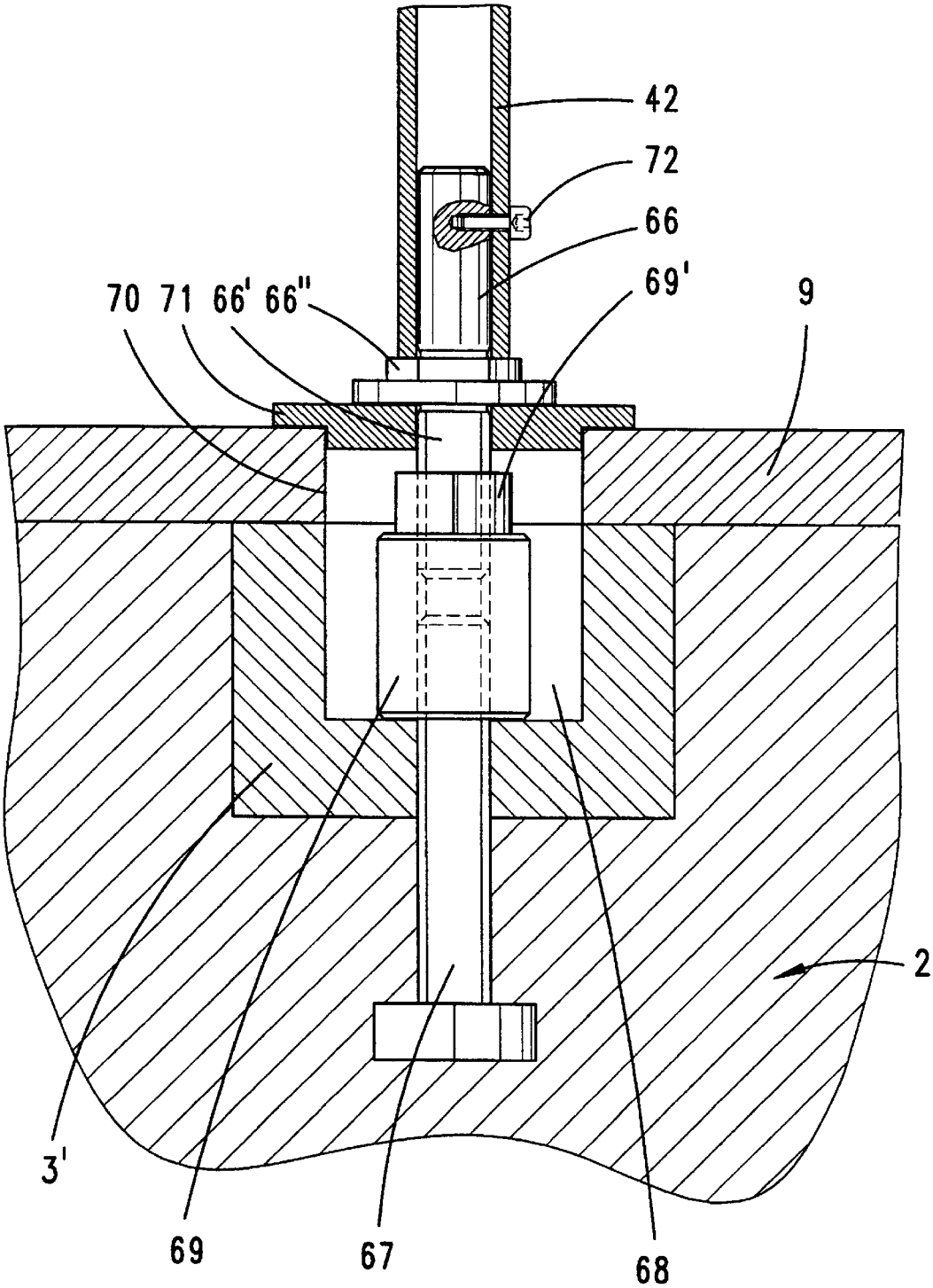
FIG. 15 shows a vertical section of the discovery boat in the region of the point of connection between a floating body cross-beam deck and a mast.

In contrast, the other two masts 42, which are situated closer to the rear, interact with plug-in bases 66 which are part of a screw connection connecting the cross-beam 3' to the floating body 2. In detail, the screw connection contains a threaded rod 67 which is securely laminated into the hull and whose stem engages through the cross-beam 3' and projects into a screw cut-out 68, which is open at the top, in the cross-beam 3'. A threaded sleeve 69, which clamps the cross-beam 3' to the floating body 2, is screwed onto the free end of the threaded rod 67. For this purpose, the threaded sleeve 69 carries, at its upper end, a hexagon head 69' for engagement of a screwing tool. Part of the hexagon head 69' projects into a hole 70 in the plate-form deck 9. The deck 9 is clamped to the threaded sleeve 69 and thus to the cross-beam 3' and to the floating body 2 by means of the plug-in base 66. The latter has a threaded pin 66' which is disposed coaxially with respect to it, engages through a cover plate 71 and is screwed into the threaded sleeve 69. The cover plate 71 closes the hole 70 and its edge engages in sealing manner against the region of the deck 9 neighbouring the hole 70. Between the threaded pin 66' and the plug-in base 66, the latter provides a hexagon 66" for engagement of a screwing tool. By screwing the threaded pin of plug-in base 66 into the threaded sleeve 69, the deck 9 is clamped to the floating body 2 and cross-beam 3' under the action of the cover plate 71. The plug-in base 66 is thereby secured in a stable manner and imparts high stability to the mast pushed onto it. In order to positionally secure the mast 42 axially, it is possible, as FIG. 15 shows, for a securing screw 72 which engages through the mast 42 and enters into a transverse thread in the plug-in base 66. However, securing of the mast 42 in question to the plug-in base 66 can be effected in any other suitable manner, for example by means of a screw-on thread, bayonet fastening etc.

Corresponding plug-in bases 65, 66 may be used in order to secure the railing 73.

What is claimed is:

1. Discovery boat having an observation cabin which is disposed on a deck connecting two floating bodies to each other, in an opening between the floating bodies, reaches below the surface of the water and has large format observation windows facing to the side and forwards, for underwater observation, wherein the two floating bodies are releasably connected to each other by crossbeams (3, 4) which carry the deck (9), the deck being formed as a platform (P) and in the opening (13) of which the observation cabin, which is formed as a transparent container and has a sealing collar protruding over the deck (9), is accommodated in a form locking manner.

2. Discovery boat according to claim 1, further comprising two ballast tanks which are, in each case, secured below the deck between the floating bodies and the container and which are fillable with water.

3. Discovery boat according to claim 2, wherein the ballast tank (44), U-shaped in plan view, surrounds container sealing collar (17) in such a manner that 2 U-web(45) of the ballas tanks faces forwards.

4. Discovery boat according to claim 2, wherein the ballast tank (44) fills an intermediate space between floating bodies (2) and a container side wall of the container.

5. Discovery boat according to claim 2, wherein the ballast tanks (44) are located above a waterline (16).

6. Discovery boat according to claim 1, wherein the container (14) has a hydrodynamically rounded front (F).

7. Discovery boat according to claim 1, wherein the container (14) is substantially formed in two parts, with a transparent, tub-like bottom part (15) and a sealing collar (17) adjoining it approximately in the region of a waterline (16) and providing connection to the deck (9).

8. Discovery boat according to claim 7, wherein sealing collar (17) forms a seat surround (20).

9. Discovery boat according to claim 1, wherein the container (14) provides space for two people sitting next to each other.

10. Discovery boat according to claim 1, further comprising control- and/or drive-actuating mechanisms (28) provided in the container (14).

11. Discovery boat according to claim 1, wherein a transparent bottom (21) of the container (14) is formed with a flat surface.

12. Discovery boat according to claim 1, further comprising a bumper arrangement (23) surrounding the container (14).

13. Discovery boat according to claim 12, wherein the bumper arrangement (23) is secured to the deck (9).

14. Discovery boat according to claim 12, wherein the bumper arrangement (23) has, in a rear region, transporting wheels projecting beyond a container bottom (21).

15. Discovery boat according to claim 12, wherein the bumper arrangement (23) forms a ring (24) encircling a container bottom.

16. Discovery boat according claim 15, wherein the ring (24) is formed as a double ring and projects below the container bottom (21).

17. Discovery boat according to claim 16, wherein the ring (24) of the bumper arrangement (23) surrounds the container bottom (21) at a spacing and is secured to the container (14) by mounting webs (62).

18. Discovery boat according to claim 16, further comprising a front rod (29) which extends from the double ring (24) and is secured to a front end of the deck (9).

19. Discovery boat according to claim 15, wherein a rear subregion of the ring (24) has axle s (26) for mounting transporting wheels (27).

20. Discovery boat according to claim 19, wherein a straight, rear region of the ring (24) is aligned with the axles (26) of the wheels.

21. Discovery boat according to claim 12, wherein the bumper arrangement (23) is mounted in a bottom region of the container (14).

22. Discovery boat according to claim 1, wherein the platform (P), which is formed by the deck, is divided in two by a separating joint (T) running in longitudinal direction of the boat.

23. Discovery boat according to claim 1, wherein at a rear end, the deck (9) is a carrier for a bench (30).

24. Discovery boat according to claim 23, further comprising a pedal crank mechanism (32) for a boat drive, wherein said pedal crank mechanism is mounted in front of the bench (30).

25. Discovery boat according to claim 23, further comprising a cool-box (31) integrated into the bench (30).

26. Discovery boat according to claim 1, further comprising a roof (41) covering the deck (9) including a container shaft (40).

27. Discovery boat according to claim 26, further comprising solar cells (43) which are disposed on the roof (41) for recharging batteries for an electric drive.

28. Discovery boat according to claim 26, wherein masts (42) for the roof (41) are based in or on the floating bodies (2).

29. Discovery boat according to claim 28, wherein at least some of the masts (42) engage through a retaining opening (64), which is spaced apart from the deck (9), in a seat surround (20) and are fixed on a plug-in base (66) associated with the deck (9).

30. Discovery boat according to claim 29, wherein the plug-in base (66) is screwed into a threaded sleeve (69) of a screw connection holding the cross-beam (3') on the hull.

31. Discovery boat according to claim 30, wherein the threaded sleeve (69) is seated in a screw cut-out (68) in the cross-beam (3') and is screwed onto a threaded rod (67) securely laminated into the hull.

32. Discovery boat according to claim 30, wherein the plug-in base (66) holds a cover plate (71).

33. Discovery boat according to claim 1, wherein the crossbeams (2', 3, 4) are inserted releasably into the floating bodies (2).

34. Discovery boat according to claim 1, wherein the floating bodies (29) form individual hulls (2', 21") which are separable transversely into two parts each.

35. Discovery boat according to claim 34, wherein the individual hulls (2', 2") are plug-connected to one another.

36. Discovery boat according to claim 34, further comprising a pedal-operated paddle wheel (34) extending between the individual hulls (2', 2").

37. Discovery boat according to claim 1, further comprising a net (53) which is stretchable over a mouth of the container (14).

38. Discovery boat according to claim 1, further comprising a double rudder system (37) with a rudder blade (38) associated with each floating body (2).

39. Discovery boat according to claim 38, further comprising a propeller drive (35) disposed between the rudder blades (38).

40. Discovery boat according to claim 39, wherein the propeller drive (35) is pivotable synchronously with the rudder blades (38).

41. Discovery boat according to claim 1, wherein a mouth of a container shaft (40) is covered by a three-part covering (56) which is unfoldable into a bench position.

* * * * *